US010378523B2

(12) United States Patent
Li

(10) Patent No.: US 10,378,523 B2
(45) Date of Patent: Aug. 13, 2019

(54) SUPPLYING DEVICE OF FIXED COLORANTS VOLUME FOR A COLORANT DISPENSER

(71) Applicant: Zhengzhou Sanhua Technology & Industry Co., Ltd, Zhengzhou (CN)

(72) Inventor: Huan Li, Zhengzhou (CN)

(73) Assignee: ZHENGZHOU SANHUA TECHNOLOGY & INDUSTRY CO., LTD, Zhengzhou (CN)

( * ) Notice: Subject to any disclaimer, the term of this patent is extended or adjusted under 35 U.S.C. 154(b) by 153 days.

(21) Appl. No.: 14/404,867

(22) PCT Filed: Mar. 6, 2013

(86) PCT No.: PCT/CN2013/072214
§ 371 (c)(1),
(2) Date: Dec. 1, 2014

(87) PCT Pub. No.: WO2013/177965
PCT Pub. Date: Dec. 5, 2013

(65) Prior Publication Data

US 2015/0144655 A1 May 28, 2015

(30) Foreign Application Priority Data

Jun. 1, 2012 (CN) ..... 2012 1 0180754

(51) Int. Cl.
*F04B 1/14* (2006.01)
*F04B 1/12* (2006.01)
(Continued)

(52) U.S. Cl.
CPC ..... *F04B 1/148* (2013.01); *B01F 3/08* (2013.01); *B01F 13/1058* (2013.01);
(Continued)

(58) Field of Classification Search
CPC ..... F04B 1/148; B01F 3/08; B01F 13/1058; B01F 15/00123; B01F 15/0237
(Continued)

(56) References Cited

U.S. PATENT DOCUMENTS 2,074,450 A * 3/1937 Alley ..... F04B 1/126 91/503
2,381,056 A * 8/1945 Huber ..... F04B 1/124 417/269
(Continued)

FOREIGN PATENT DOCUMENTS

CN 2318426 Y 5/1999
CN 101418784 A 4/2009
(Continued)

OTHER PUBLICATIONS

International Search Report for Application No. PCT/CN2013/072214 dated Jun. 6, 2013.

*Primary Examiner* — Patrick M. Buechner
*Assistant Examiner* — Michael J. Melaragno
(74) *Attorney, Agent, or Firm* — Hamre, Schumann, Mueller & Larson, P.C.

(57) ABSTRACT

Disclosed is a supplying device of fixed colorants volume for a colorant dispenser. The supply device includes: a colorant source; a cylinder body having multiple piston cylinders arranged around a circumferential direction thereof; a swashplate having an oblique surface and arranged substantially coaxially with the cylinder body; multiple piston mechanisms, where each piston mechanism includes a piston rod and a piston connected to the piston rod, the piston rod has a rolling abutment structure abutting against the oblique surface, and the piston is constructed to be capable of making a stroke movement in the corresponding piston cylinder by means of rotation of the swashplate; an actuator for actuating the swashplate; a controller opera-
(Continued)

tively connected to the actuator to control the amount of rotation of the swashplate; and an outlet for dispensing a colorant. Preferably, the supply device further includes an axial reset mechanism and a circumferential reset mechanism.

15 Claims, 10 Drawing Sheets

(51) Int. Cl.

| | |
|---|---|
| ***F04B 9/04*** | (2006.01) |
| ***F04B 1/29*** | (2006.01) |
| ***B01F 3/08*** | (2006.01) |
| ***B01F 15/00*** | (2006.01) |
| ***B01F 15/02*** | (2006.01) |
| ***B01F 13/10*** | (2006.01) |
| ***F04B 13/00*** | (2006.01) |
| ***F04B 49/035*** | (2006.01) |

(52) U.S. Cl.
CPC .... *B01F 15/00123* (2013.01); *B01F 15/0237* (2013.01); *F04B 1/124* (2013.01); *F04B 1/146* (2013.01); *F04B 1/29* (2013.01); *F04B 9/042* (2013.01); *F04B 13/00* (2013.01); *F04B 49/035* (2013.01); *B01F 2215/005* (2013.01); *F04B 2201/1208* (2013.01); *F04B 2201/12041* (2013.01)

(58) Field of Classification Search
USPC ..... 222/32; 417/269, 271
See application file for complete search history.

(56) References Cited

U.S. PATENT DOCUMENTS 2,381,585 A * 8/1945 Gambrell ..... F02M 59/04 417/269
2,384,012 A * 9/1945 Bremser ..... F02M 59/00 417/269
2,439,879 A * 4/1948 Allen ..... F02M 41/08 417/269
2,821,932 A * 2/1958 Lucien ..... F01B 3/0002 417/269
2,969,810 A * 1/1961 Dudley ..... F04B 1/124 137/625.15
3,016,837 A * 1/1962 Dlugos ..... F04B 1/124 417/269
3,175,510 A * 3/1965 D Amato ..... F04B 1/124 91/505
3,249,052 A * 5/1966 Karlak ..... B01F 15/0454 417/269
3,257,960 A * 6/1966 Keel ..... F04B 1/14 417/269
3,323,461 A * 6/1967 Bennett ..... F01B 3/06 417/339
3,663,122 A * 5/1972 Kitchen ..... F04B 1/126 417/269
3,679,328 A * 7/1972 Cattanach ..... F04B 1/145 417/270
3,712,758 A * 1/1973 Lech ..... F04B 1/124 417/214
3,746,476 A * 7/1973 Bradley ..... F04B 49/243 417/269
4,448,550 A * 5/1984 Moroney ..... F16C 21/00 384/127
4,448,692 A * 5/1984 Nakamoto ..... B01D 15/14 210/101
4,566,858 A * 1/1986 Akiba ..... F04B 11/0058 417/22
4,753,581 A * 6/1988 Hiscock ..... F04B 11/0066 417/269
4,825,753 A * 5/1989 Inoue ..... F04B 1/2085 74/60
5,013,219 A * 5/1991 Hicks ..... F04B 1/14 417/269
5,061,155 A * 10/1991 Masaoka ..... F04B 1/28 417/214
5,110,087 A * 5/1992 Studtmann ..... H01F 7/13 251/129.16
5,253,576 A * 10/1993 Bethke ..... F04B 1/2085 29/888
5,259,738 A * 11/1993 Salter ..... F04B 7/0076 417/270
5,393,204 A * 2/1995 Kawahara ..... F16C 33/6659 184/6.16
5,456,581 A * 10/1995 Jokela ..... F04B 1/18 417/270
5,676,035 A * 10/1997 Chrestoff ..... F04B 1/126 384/121
5,678,471 A * 10/1997 Ash, Jr. ..... F01B 3/0002 417/269
5,737,996 A * 4/1998 Hansen ..... F04B 1/2035 417/269
5,738,000 A * 4/1998 Forster ..... F01B 3/0005 184/6.17
5,755,562 A * 5/1998 Novacek ..... F02M 59/04 417/269
5,794,515 A * 8/1998 Bethke ..... F01B 3/007 91/506
5,931,644 A * 8/1999 Glassey ..... F04B 1/2014 417/269
6,186,747 B1 * 2/2001 Zhou ..... F04B 53/143 222/321.9
6,354,186 B1 * 3/2002 Gibson ..... F04B 1/148 92/157
6,357,336 B1 * 3/2002 Wittmann ..... F16C 19/54 74/60
6,517,331 B1 * 2/2003 Gibson ..... F04B 1/148 417/270
6,655,255 B2 * 12/2003 May ..... F04B 1/324 91/506
6,726,065 B2 4/2004 Sanders
7,556,481 B2 * 7/2009 Moubayed ..... F04B 43/1253 417/477.1
8,333,571 B2 * 12/2012 Mehta ..... F04B 9/042 417/269
8,657,589 B2 * 2/2014 Stein ..... F04B 49/03 417/270
8,696,337 B2 * 4/2014 Liu ..... F04B 1/122 417/534
2001/0007635 A1 * 7/2001 Yokomachi ..... F04B 27/0895 417/269
2003/0210990 A1 * 11/2003 Yeh ..... F04B 27/0804 417/269
2004/0057836 A1 * 3/2004 Abdelrahman ..... F04B 1/141 417/53
2005/0238501 A1 * 10/2005 Brailovskiy ..... F04B 1/146 417/222.1
2006/0110265 A1 * 5/2006 Lanfredi ..... F04B 1/146 417/269
2006/0275149 A1 * 12/2006 Bergmann ..... F04B 1/148 417/269
2007/0101858 A1 5/2007 Jacobs et al.
2007/0120432 A1 * 5/2007 Vaden ..... F01B 3/007 310/80
2007/0272075 A1 * 11/2007 Nathan ..... F04B 1/148 91/499
2008/0219861 A1 * 9/2008 Raleigh ..... F04B 9/042 417/271
2009/0236367 A1 9/2009 Voskuil et al.

(56) References Cited

U.S. PATENT DOCUMENTS

| | | | | |
|---|---|---|---|---|
| 2010/0278463 | A1* | 11/2010 | Becker | F04B 1/2085 384/2 |
| 2015/0144655 | A1* | 5/2015 | Li | F04B 1/29 222/32 |

FOREIGN PATENT DOCUMENTS

| | | | |
|---|---|---|---|
| CN | 102705191 | A | 10/2012 |
| JP | 2003148326 | A | 5/2003 |
| WO | 0225225 | A1 | 3/2002 |

* cited by examiner

SUPPLYING DEVICE OF FIXED COLORANTS VOLUME FOR A COLORANT DISPENSER

CROSS-REFERENCE TO RELATED APPLICATIONS

The present application is a national phase entry under 35 U.S.C. § 371 of International Application No. PCT/CN2013/072214 filed Mar. 6, 2013, which claims priority from Chinese Patent Application No. 201210180754.0 filed Jun. 1, 2012.

TECHNICAL FIELD

The present invention relates to the field of coating color matching, and more particularly to the field of full-automatic coating color matching. In particular, the present invention relates to a supplying device of fixed colorants volume for a colorant dispenser in an automatic coating color matching system. In addition, the present invention further relates to a colorant dispenser having the supplying device of fixed colorants volume.

RELATED ART

In the field of coating color matching, a coating of a desired color is obtained usually by quantitatively pumping a predetermined colorant to a primer. Nowadays, people have higher requirements on colors, and therefore, precision of the amount of colorant fluid provided is critical for judging a color matching system and even quality of the coating. Moreover, at present, it is required that a colorant should be supplied rapidly, and therefore, a maximum colorant supply quantity per unit time of a colorant supply apparatus of a color matching system is expected to be improved. In addition, a colorant is generally in a form of abrasive viscous fluid (for example, the colorant contains mineral particles), which may have a negative effect on the service life of the colorant supply apparatus of the color matching system.

The prior art discloses multiple fluid dispensing systems for a colorant. For instance, the International Publication Document WO02/25225A1 discloses a fluid dispensing system, having a computer control system operatively connected to a stepper motor, the stepper motor being connected to a nutating pump (generally called DVX pump). The stepper motor actuates the nutating pump with a resolution less than a full revolution. The computer control system determines the number of steps according to a desired amount of fluid to be pumped by the nutating pump, so as to rotate the piston with a resolution less than a full revolution.

In addition, the U.S. Pat. No. 6,726,065B2 discloses an automatic colorant dispenser, having a modular colorant design, where a colorant module thereof is provided with a colorant canister, and a pump module connected to the colorant canister, and the pump module includes a stepper motor, a bearing shaft, a chamber receiving the bearing shaft, twin impellers rotated by the bearing shaft, and a seal. The twin impellers are disposed in the chamber for pumping a colorant quantitatively.

However, these existing colorant dispensing systems still cannot desirably solve the existing technical problems. For example, these colorant dispensing systems only have one pump channel, in a pump or module, for pumping colorant fluid, resulting in a small value of the maximum fluid amount pumped per unit time. In addition, a large number of moving parts of the pumps of the fluid dispensing systems in the prior art are severely worn, affecting the service life. Therefore, a demand for a colorant supply apparatus providing a precise colorant supply quantity, having a high maximum supply quantity per unit time and having a desirable service life remains to be met.

SUMMARY

According to a solution of the present invention, a supplying device of fixed colorants volume for a colorant dispenser, is provided, including: a colorant source; a cylinder body having multiple piston cylinders arranged around a circumferential direction thereof; a swashplate having an oblique surface and arranged substantially coaxially with the cylinder body, configured to be capable of rotating around a longitudinal axis thereof and relative to the cylinder body; multiple piston mechanisms, where each piston mechanism includes a piston rod and a piston connected to the piston rod, the piston rod has a rolling abutment structure abutting against the oblique surface, and the piston is configured to be capable of making a stroke movement in the corresponding piston cylinder by means of rotation of the swashplate; an actuator for actuating the swashplate; a controller operatively connected to the actuator to control the amount of rotation of the swashplate; and an outlet for dispensing a colorant. The stroke movement of each piston includes a first stroke and a reverse second stroke, in the first stroke, the piston cylinder of the piston is communicated with the colorant source so as to suck a colorant from the colorant source, and in the second stroke, the sucked colorant is discharged out of the piston cylinder.

In the solution, the device may include an axial reset mechanism for biasing the rolling abutment structure towards the oblique surface along an axial direction.

In the solution, the device may further include a circumferential reset mechanism, configured to be capable of applying a circumferential restoring force to the rolling abutment structure during rotation of the swashplate so as to make the rolling abutment structure to tend to restore a predetermined abutment state with the oblique surface.

Through the device of the present invention, good pumping precision is provided. More importantly, a maximum pumping quantity per unit time can be effectively enhanced. Furthermore, the device provides a low-friction runtime environment while implementing normal pumping, which can effectively extend the service life of the device.

In addition, as the multiple piston mechanisms substantially uniformly abut against the swashplate during operation, abrasion (if any) of the swashplate would be uniform, and therefore, after the swashplate is worn, precision of a colorant supply quantity of the device is not significantly affected. This allows the device to have a longer effective service time.

According to another solution of the present invention, a supplying device of fixed colorants volume for a colorant dispenser is provided, including: a colorant source; a cylinder body having multiple piston cylinders arranged around a circumferential direction thereof; a swashplate having an oblique surface and arranged substantially coaxially with the cylinder body, configured to be capable of rotating around a longitudinal axis thereof and relative to the cylinder body; multiple piston mechanisms, where each piston mechanism includes a piston rod and a piston connected to the piston rod, the piston rod has a rolling abutment structure abutting against the oblique surface, and the piston is configured to be capable of making a stroke movement in the corresponding piston cylinder by means of rotation of the swashplate; an actuator for actuating the swashplate; a controller operatively connected to the actuator to control the amount of rotation of the swashplate; and an outlet for dispensing a colorant. The stroke movement of each piston may include a first stroke and a reverse second stroke, in the first stroke, the piston cylinder of the piston is communicated with the colorant source so as to suck a colorant from the colorant source, and in the second stroke, the sucked colorant is discharged out of the piston cylinder. The device may further include a zero position indicating mechanism, used for indicating a zero position for rotation of the swashplate relative to the cylinder body.

With the configuration of the present invention, a precise amount of fluid can still be supplied even after long-term use.

According to a preferred embodiment, the device further includes a three-way valve disposed between the piston cylinder and the outlet, and the three-way valve is configured to selectively allow the colorant discharged from the piston cylinder to flow to the outlet or to return to the colorant source. Through such setting, in a process of resetting the swashplate to the zero position, the three-way valve is configured to allow the colorant discharged from the piston cylinder to flow back to the colorant source.

According to another solution of the present invention, a colorant dispenser is provided, which has at least one, preferably multiple, for example, four, six, eight or sixteen supplying devices of fixed colorants volume according to the present invention.

Some of other features of the present invention are obvious or well-known in the art, and some will be described below with reference to the objectives, functions, effects and/or advantages thereof. Through the following description and accompanying drawings, persons skilled in the art will understand other objectives and advantages of the present invention.

BRIEF DESCRIPTION OF THE DRAWINGS

Embodiments of the present invention are described below in detail with reference to the accompanying drawings, where.

Figure 1:
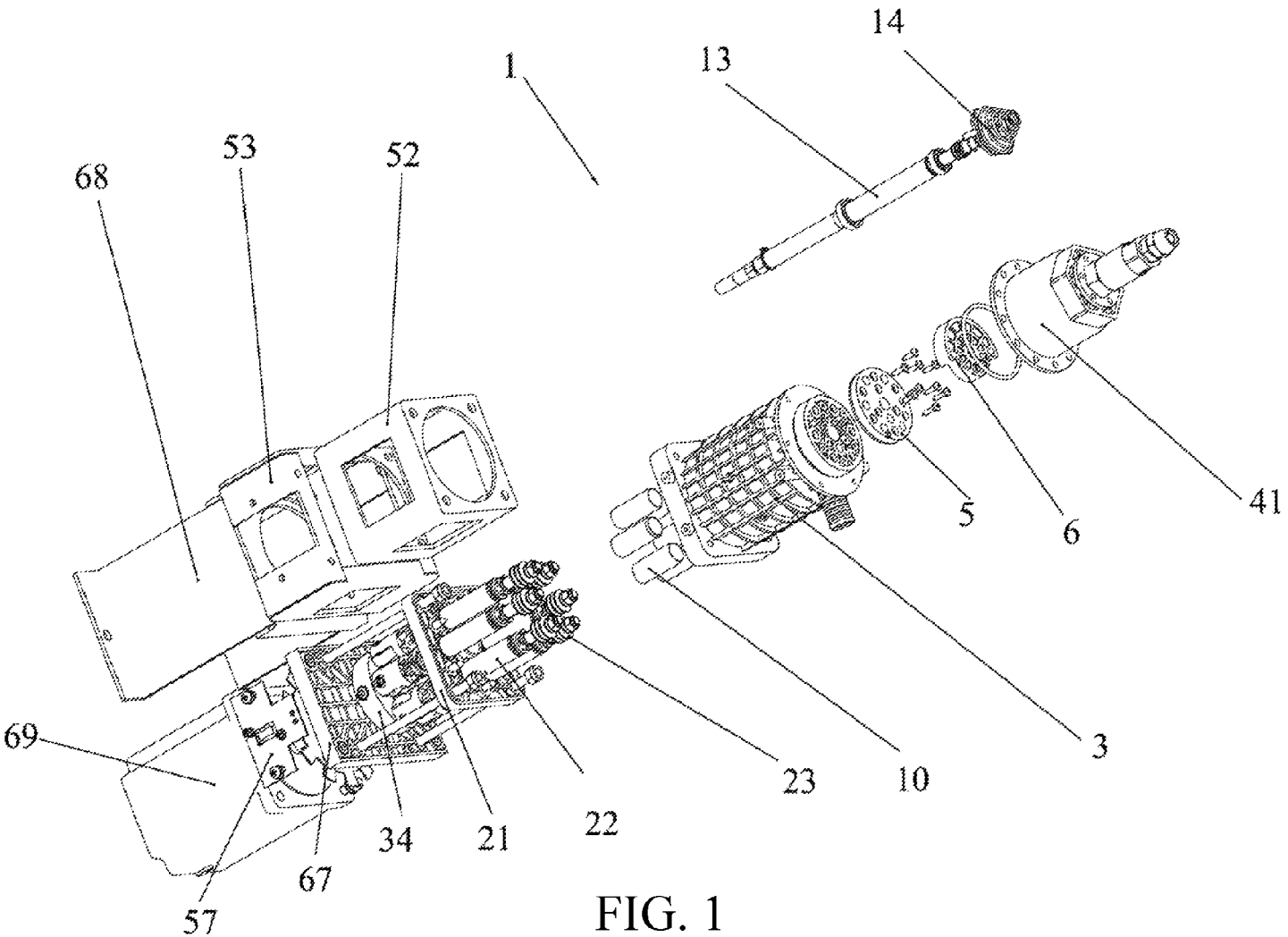
FIG. 1 is an exploded perspective view of an embodiment of a supplying device of fixed colorants volume for a colorant dispenser according to the present invention.
Figure 2:
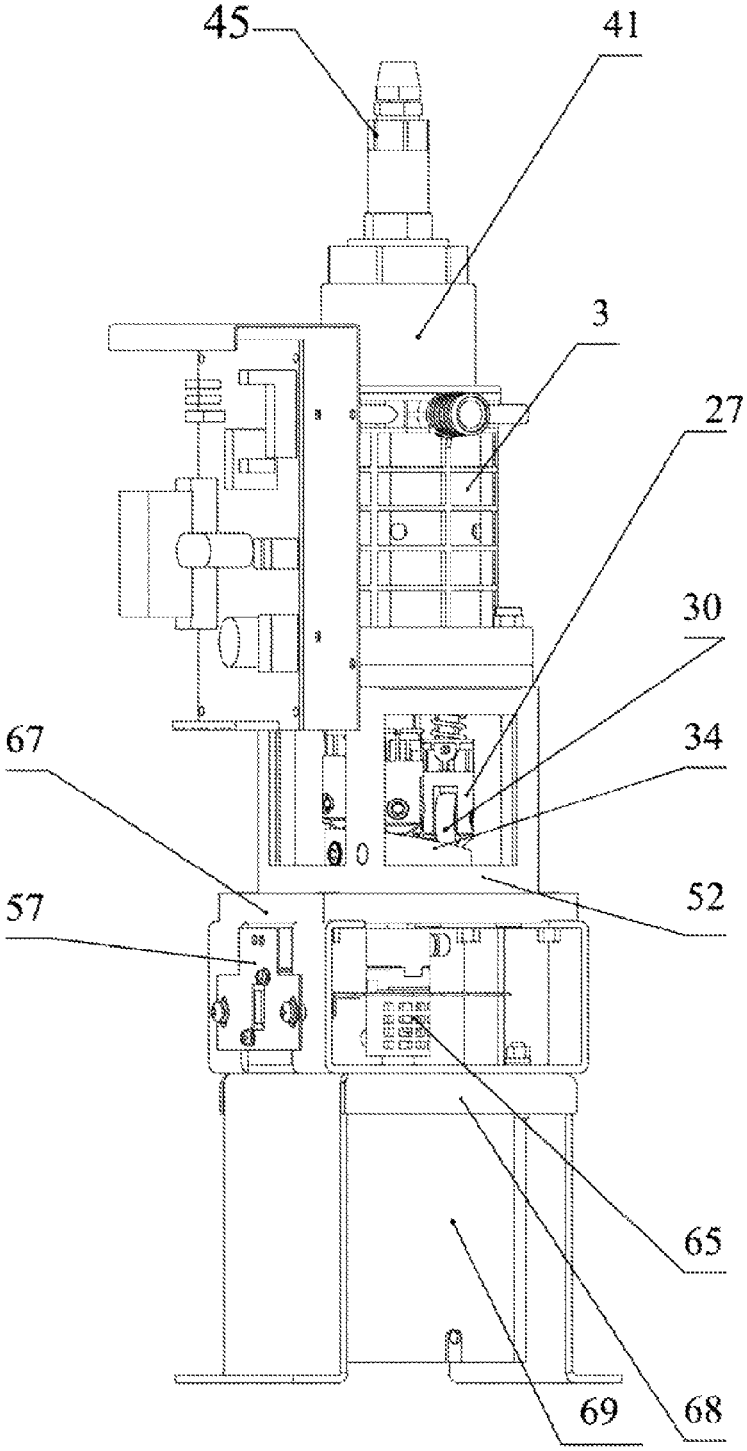
FIG. 2 is a side view of the embodiment of the supplying device of fixed colorants volume for a colorant dispenser according to the present invention.

In the specification and the drawings of the present invention, the same or similar reference signs indicate the same or similar features or elements.

List of reference signs: 1: supplying device of fixed colorants volume for a colorant dispenser; 2: colorant inlet; 3: cylinder body; 5: fixed valve plate; 6: movable valve plate; 10: sleeve member; 11: rod portion; 13: spindle; 14: pressing mechanism; 15: first fixed valve plate opening; 16: second fixed valve plate opening; 17: communicating groove; 18: three-way valve; 21: cylinder bottom cap; 22: piston rod; 23: piston; 25, 25A: piston cylinder; 27: bearing seat; 28: spring; 29: bearing; 30: outer member (spherical suite); 31: pivot; 32: first end of the spring; 33: second end of the spring; 34: swashplate (drive plate); 41: end cover; 42: end cover cavity; 45: check valve; 52: shield; 53: support; 57: sensor fixture; 58: sensor mechanism; 58A: first sensor; 58B: second sensor; 63: zero position indicating dial; 65: coupling; 67: connecting frame; 68: support; 69: stepper motor; S: colorant source; O: output; A-F: piston mechanisms (piston cylinders); I-XII: rotation positions of the swashplate; $\alpha$: rotation angle; $\beta$: swashplate angle; L1-L3: projection distances of the rotation positions; and H1-H3: strokes of the piston mechanism.

DETAILED DESCRIPTION

Exemplary solutions of the system and the method of the present invention are illustrated in detail with reference to the following description and the accompanying drawings. The drawings are not necessarily drawn to scale, and some features may be exaggerated, removed, or partially sectioned to better illustrate and explain the present invention. In addition, although the drawings depict some possible solutions, the description herein is not intended to be exhaustive or otherwise limit the scope of the present invention to the illustration in the drawings and the specific forms and structures disclosed in the following detailed description.

In addition, some directional expressions will be introduced to the following description. In general cases, the directional terms such as "upward", "downward" and other directional terms will be construed as having their normal meanings and relating to the directions when the drawings are viewed normally. However, it is not intended to limit the scope and the solution of the present invention only to the implementation according to these directions. For example, the supplying device of fixed colorants volume shown in the drawings includes an outlet on the top and a stepper motor at the bottom, but in other embodiments of the present invention, it is also feasible to have the outlet at the bottom.

FIG. 1 is an exploded perspective view of a supplying device of fixed colorants volume for a colorant dispenser 1 according to the present invention. The supplying device of fixed colorants volume for a colorant dispenser 1 of the present invention is applied to the field of coating color matching, especially applied to a pumping mechanism in an automatic color matching system, for example, a colorant dispenser. Herein, the term "colorant" should have a broad meaning of any fluid or viscous fluid applied to the field of coating color matching, including, but not limited to a variety of paints and coatings.

Figure 3:
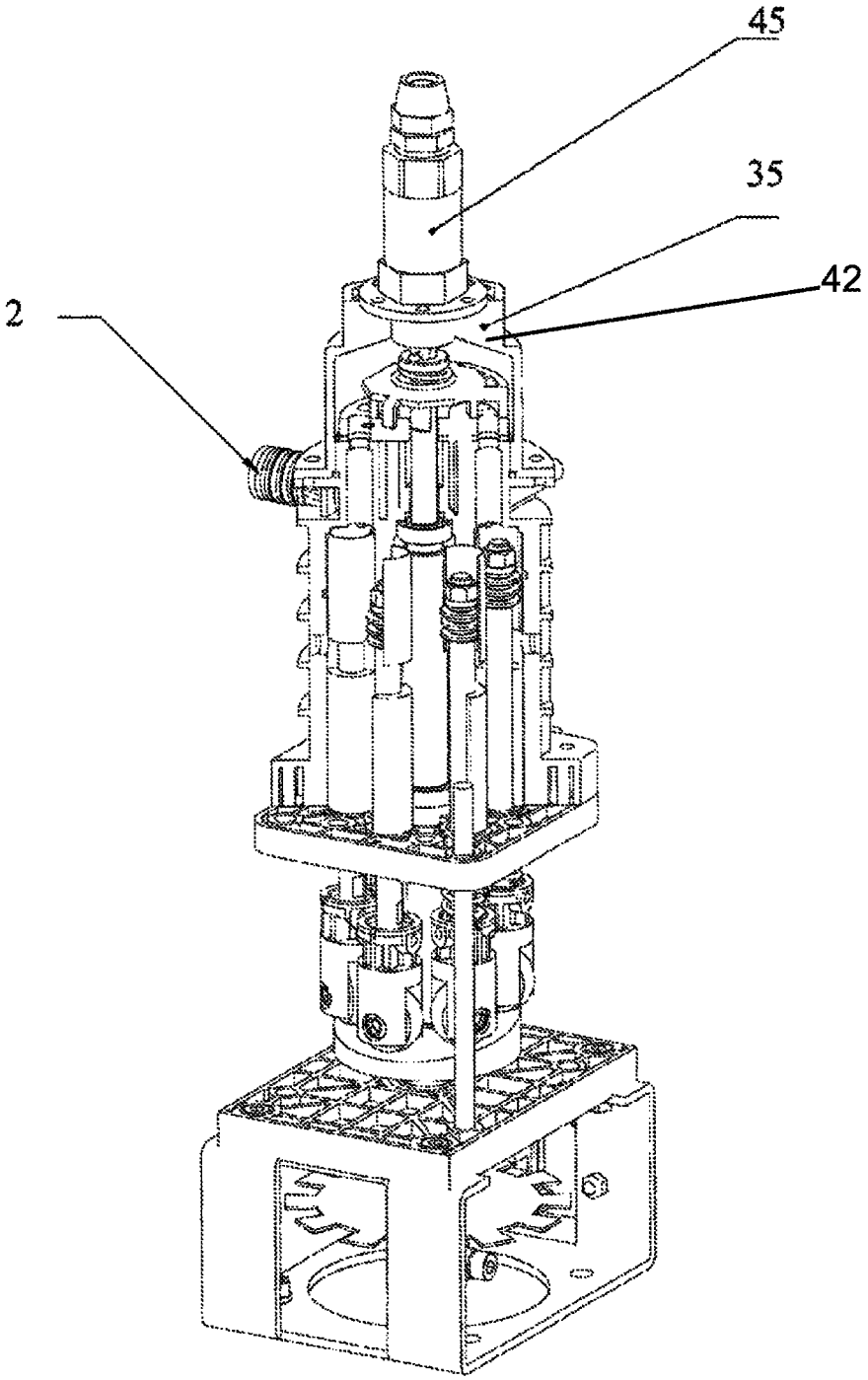
FIG. 3 is a partial sectional view of the embodiment of the supplying device of fixed colorants volume for a colorant dispenser according to the present invention, where some parts of the device are removed so as to illustrate an internal structure of the device.
Figure 6:
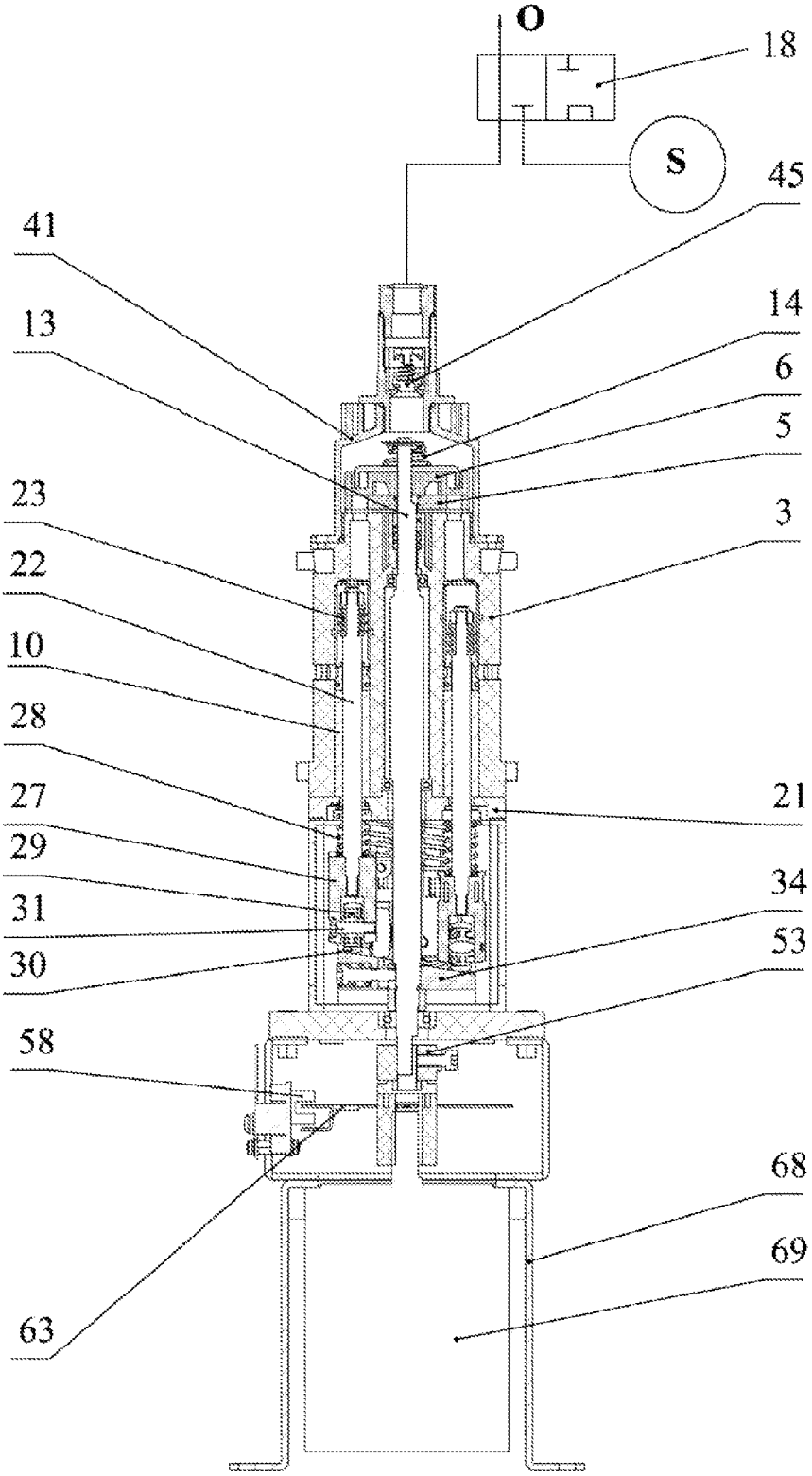
FIG. 6 is a side sectional view of the embodiment of the supplying device of fixed colorants volume for a colorant dispenser according to the present invention.

As shown in FIG. 6, the supplying device of fixed colorants volume for a colorant dispenser 1 has a colorant source S. The colorant source S supplies a colorant through a colorant inlet 2 of the supplying device of fixed colorants volume as shown in FIG. 3 for a colorant dispenser 1. As shown in the figures, especially in FIG. 4, the supplying device of fixed colorants volume for a colorant dispenser 1 further includes a cylinder body 3 having multiple piston cylinders 25 and 25A arranged around a circumferential direction thereof, the number of which, as shown in the figure, is six, but more or less piston cylinders can be disposed. The colorant source is selectively communicated with a corresponding piston cylinder 25 through the colorant inlet and supplies a colorant thereto. The supplying device of fixed colorants volume for a colorant dispenser 1 further includes multiple piston mechanisms correspondingly located in the piston cylinders 25. The piston mechanisms each include a piston rod 22, a piston 23 connected to one end of the piston rod and a rolling abutment structure located on the other end of the piston rod, which will be detailed hereinafter.

As shown in the figure, as an important feature of the present invention, the supplying device of fixed colorants volume for a colorant dispenser 1 further includes a drive plate 34 arranged substantially coaxially with the cylinder body, and the drive plate is in a form of a swashplate with an oblique surface. The rolling abutment structure abuts against the oblique surface. In the present invention, the swashplate is configured to be capable of rotating around a longitudinal axis thereof (which is also the longitudinal axis of the cylinder body) and relative to the cylinder body. In a preferred embodiment of the present invention, the cylinder body is fixed on a rack of the device, and the swashplate is rotatable around a rotation axis, but it is also feasible that the swashplate is fixed on the rack of the device and the cylinder body is rotatable around a rotation axis.

Figure 9:
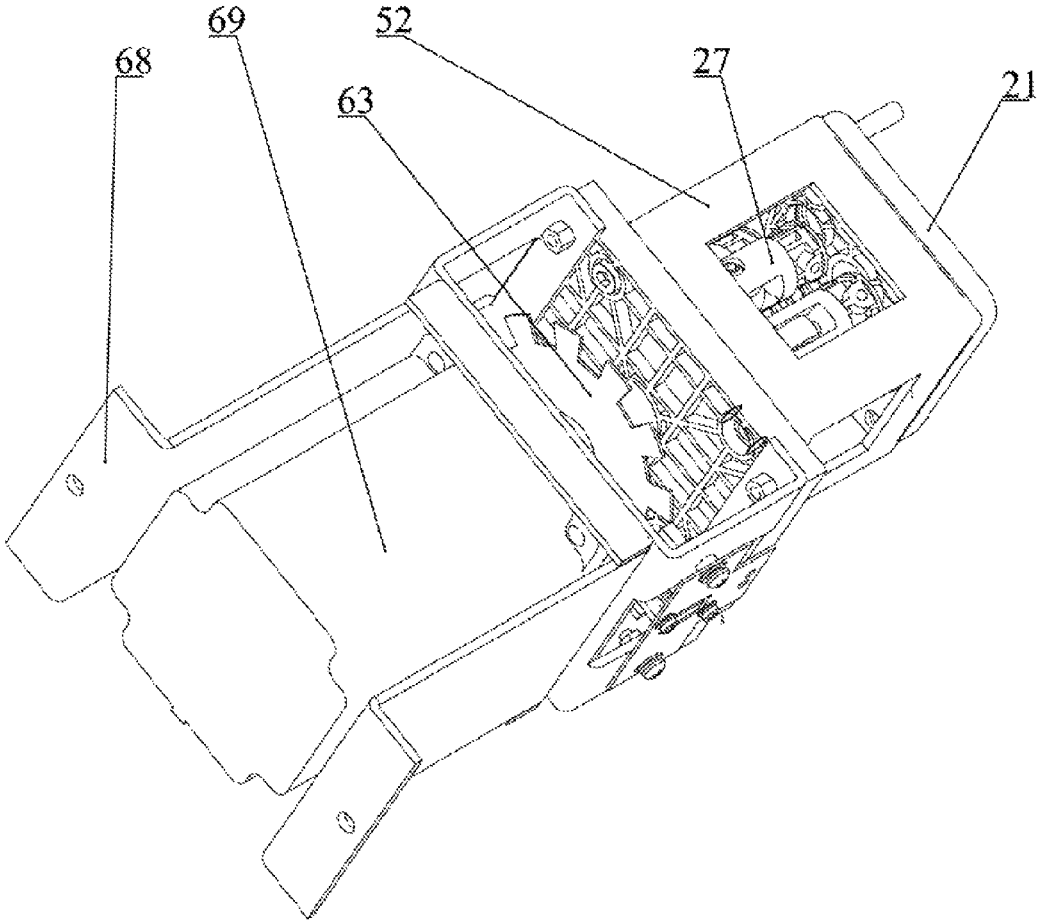
FIG. 9 is a partial perspective view of the embodiment of the supplying device of fixed colorants volume for a colorant dispenser according to the present invention.

As shown in FIG. 1, the supplying device of fixed colorants volume for a colorant dispenser 1 is further provided with an actuator for actuating the swashplate. In an illustrated embodiment, the actuator is in a form of a stepper motor 69, but may also be other suitable actuating mechanisms. In addition, the supplying device of fixed colorants volume for a colorant dispenser 1 is further provided with a controller for controlling the amount of rotation of the actuator. Suitable controllers are known in the art, and any suitable actuator can be selected. As shown in FIG. 1 and FIG. 9, the stepper motor 69 is supported by a stepper motor support 68, and is connected to a spindle 13 of the supplying device of fixed colorants volume for a colorant dispenser 1 through a coupling 65. The spindle 13 is then non-rotatably connected to the swashplate 34, and the spindle 13 passes through a shaft hole formed in the cylinder body 3 and is substantially coaxial with the longitudinal axis of the swashplate 34 and the cylinder body 3. Persons skilled in the art can think of other drive configuration, for example, the stepper motor directly drives the swashplate.

In an operation process of the supplying device 1 according to the present invention, the controller controls rotation of the actuator as stated above. Through abutment between the swashplate 34 and the rolling abutment structure, rotation of the swashplate 34 causes the pistons 23 to make corresponding stroke movements in the corresponding piston cylinders 25 and 25A. The stroke movement of each piston includes a first stroke and a reverse second stroke, in the first stroke, the piston cylinder 25 of the piston 23 is communicated with the colorant source S so as to suck a colorant through the colorant inlet 2, and in the second stroke, the sucked colorant is discharged out of the piston cylinder 25, and is discharged and dispensed through an outlet (not shown) of the supplying device 1. Therefore, by controlling the amount of rotation of the actuator, control over the amount of fluid supplied by the supplying device 1 can be achieved eventually, so as to achieve the purpose of quantitatively supplying a colorant.

The specific structure of the piston structure according to the present invention and interaction of the piston structure with the swashplate are described below according to multiple figures of the present invention, especially FIG. 4, FIG. 5 and FIG. 8. As mentioned above, because the supplying device is configured to pump a colorant and it is required that the amount of the supplied colorant should be controlled precisely, the supplying device 1 according to the present invention needs to run in a case where there is no or hardly any lubricant, especially liquid lubricant, to avoid that the lubricant affects the quality or supply quantity of the colorant. For example, there is no liquid lubricant in the supplying device 1, and only some solid lubricants, for example, grease, are applied on a position where the rolling abutment structure and the oblique surface abut against each other. However, for example, a contact position between the piston rod and the swashplate 34 withstands a greater force, and therefore, if there is no suitable antifriction means, the service life of the supplying device 1 will be significantly reduced. In view of this, the present invention provides the rolling abutment structure, configured such that at least a part of contact between the rolling abutment structure and the oblique surface of the swashplate 34 is rolling contact, so as to significantly reduce friction of contact parts.

Figure 4:
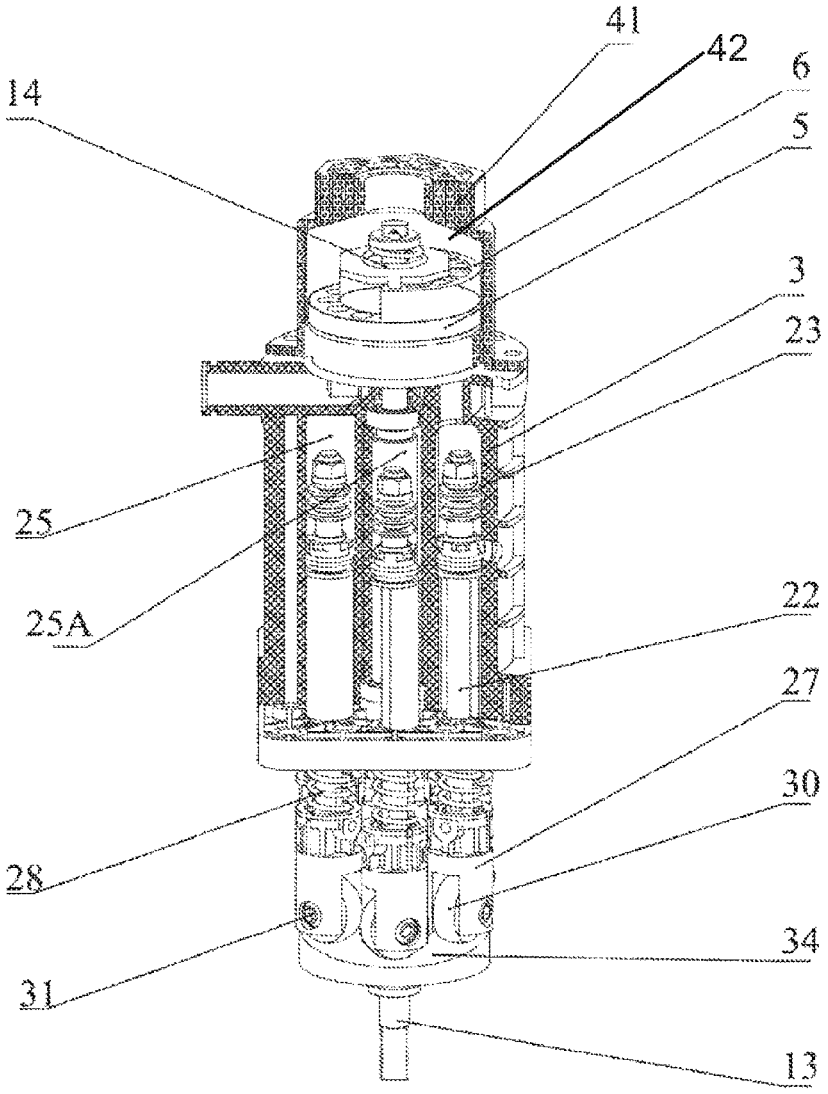
FIG. 4 is a partial sectional view of the embodiment of the supplying device of fixed colorants volume for a colorant dispenser according to the present invention, where a piston mechanism according to the present invention is specifically illustrated.
Figure 8:
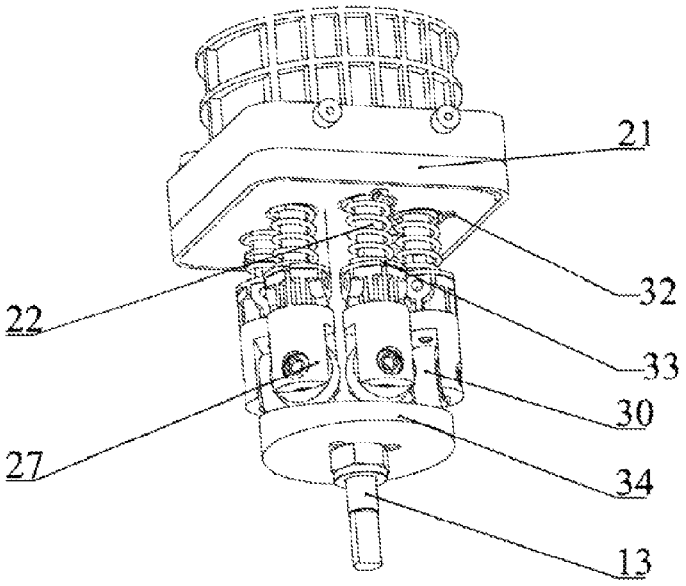
FIG. 8 is a partial perspective view of the embodiment of the supplying device of fixed colorants volume for a colorant dispenser according to the present invention, where a rolling abutment structure and a reset mechanism according to the present invention are specifically illustrated.

As specifically shown in FIG. 4 and FIG. 8, the piston rod 22 includes a rod body having a first end and a second end, where the first end is connected to the piston 23, and the second end is rotatably connected to the rolling abutment structure. Specifically, the rolling abutment structure is rotatable around a longitudinal axis of the rod body and relative to the rod body. The rolling abutment structure includes a bearing seat 27 and a rolling bearing member pivotally mounted on the bearing seat. The bearing seat 27 may be made of any suitable material, for example, plastic. The rolling bearing member includes a pivot 31 fixedly mounted on the bearing seat, a bearing 29 sleeved over the pivot 31 and an outer member (spherical suite) 30 sleeved over a bearing 29, and the spherical suite at least partially defines a spherical contact surface abutting against the oblique surface of the swashplate. The bearing 29 may be any suitable bearing, for example, a ball, a roller or a thrust bearing, an inner ring of the bearing is fixedly connected to the pivot 31, and an outer ring is fixedly connected to an inner hole of the outer member 30. With the above configuration, the outer member 31, for example, a spherical contact surface thereof, at least rotates around two directions, that is, around the longitudinal axis of the rod body and around the pivot, and therefore, excellent low-friction contact between the piston rod 22 and the swashplate 34 can be provided. In order to achieve balance between the friction, which is required to be as low as possible, and a long service life, preferably, the spherical suite 30 or a part or all of the spherical contact surface thereof is made of a rigid metal, such as aluminum alloy or stainless steel, and a part or all of the spherical contact surface thereof is coated with a solid lubricating material, for example, lubricant such as grease. Alternatively, the spherical suite 30 or a part or all of the spherical contact surface thereof may be made of a low-friction material meeting rigidity conditions, for example, a self-lubricating material such as teflon.

Figure 5:
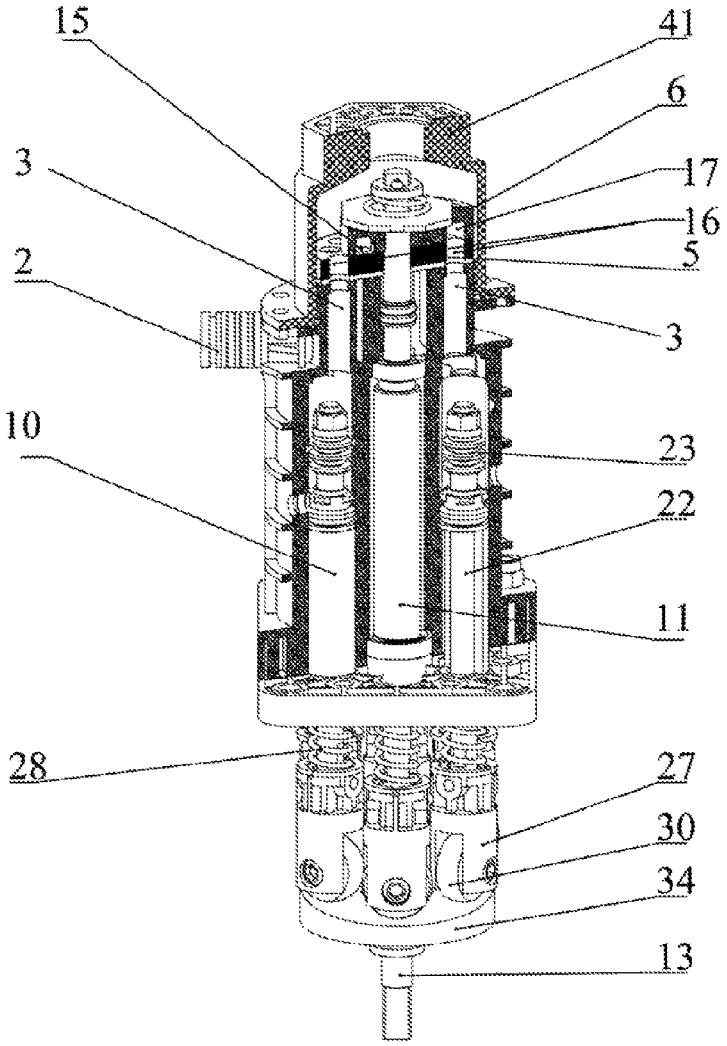
FIG. 5 is a partial sectional view of the embodiment of the supplying device of fixed colorants volume for a colorant dispenser according to the present invention, where a spindle of the supplying device of fixed colorants volume according to the present invention is specifically illustrated.

Referring to FIG. 4, FIG. 5 and FIG. 8, in order to enable the piston mechanism to abut against the swashplate all the time during rotation of the swashplate so as to implement a corresponding stroke movement, the supplying device 1 according to the present invention further has an axial reset mechanism for biasing the rolling abutment mechanism towards the oblique surface along an axial direction, which is in a form of a spring in the illustrated embodiment. As shown in the figure, the spring 28 is sleeved over each piston mechanism, and is located between a cylinder bottom cap 21 of the cylinder body 3 and the bearing seat 27 of the rolling abutment structure. However, any other suitable longitudinal reset mechanism is also feasible.

In addition, in order to further reduce friction between the swashplate 34 and the piston rod 22 (the rolling abutment structure), the supplying device 1 is further provided with a circumferential reset mechanism, configured to be capable of applying a circumferential restoring force to the rolling abutment structure during rotation of the swashplate, so that the rolling abutment structure at least partially and preferably wholly tends to restore a predetermined abutment state with the oblique surface. It should be noted that, the term "circumferential" of the circumferential reset mechanism generally refers to a circumferential direction of the piston rod or the rolling abutment structure.

Although the following description is only used for explanation instead of limitation, generally, the rolling abutment structure may have an optimal or preferred state of abutment against the swashplate, and when the rolling abutment structure is in rolling contact along the swashplate in the optimal or preferred state, friction of the rolling abutment structure is as small as possible; and during rotation of the swashplate, if there is no circumferential reset mechanism, abutment between the rolling abutment structure (spherical suite 30) and the swashplate may deviate from the foregoing state, and therefore, it is likely that the abutment therebetween is no longer rolling contact, or the degree of rolling contact decreases. This may be similar to contact with a road surface when a vehicle travels along a straight road (rolling contact is maximized) and when the vehicle makes a turn (the degree of rolling contact is reduced or there is no rolling contact).

In the illustrated embodiment, the circumferential reset mechanism is also provided by the spring 28, and the spring 28 has a first end 32 fixedly connected to the rolling abutment structure and a second end 33 fixedly connected to the cylinder body. When the outer member 30 of the rolling abutment structure deviates from a predetermined (for example, ideal) rolling contact state, the first end 32 and the second end 33 of the spring 28 may apply a substantially circumferential restoring force to the rolling abutment structure so that the rolling abutment structure tends to restore the predetermined rolling contact state. Although in the illustrated preferred embodiment, the axial reset mechanism and the circumferential reset mechanism are jointly formed by a spring 28, the axial reset mechanism and the circumferential reset mechanism may be provided separately, as long as they can separately implement their own functions. Alternatively, the axial reset mechanism and/or the circumferential reset mechanism each may include multiple members. The spring 28, as shown in the figure, is a coil spring, but it may be any other suitable spring mechanism.

As the colorant is generally abrasive viscous fluid, the colorant is expected to be separated from moving parts or contact parts of the supplying device 1. Therefore, the piston can be configured such that the colorant in the piston cylinders 25 and 25A is isolated from the piston rod 22 in a colorant impermeable manner, so that the colorant does not have a negative effect on the movement of the piston rod 22 in the piston cylinders 25 and 25A and the abutment between the rolling abutment structure and the swashplate 34. Specifically, as shown in FIG. 3 to FIG. 7, the piston 23 includes multiple spaced piston members, where the multiple piston members can be engaged with the piston cylinders 25 and 25A in a sealed manner so as to prevent the colorant from entering piston cylinder space having the piston rod 22 via space of the piston cylinders 25 and 25A in front of the piston 23.

In order to further reduce movement of the supplying device 1 and/or friction between frictional parts, the supplying device may further include a sleeve member 10 sleeved over the piston rod. The sleeve member 10 can be fixedly mounted in each of the piston cylinders 25 and 25A and can slide relative to the piston rod 22. The sleeve member 10 may be made of a low-friction material, for example, a self-lubricating material such as teflon. As a particularly preferred embodiment, an inner side of the sleeve member 10 is provided with a plurality of grooves, many balls are placed in the grooves, and the piston rod 22 is preferably at least partially in rolling contact relative to the balls.

As shown in FIG. 5, a rod portion 11 passing through the cylinder body 3 is formed on the spindle 13, and the rod portion 11 may be provided with bearings on both ends so as to facilitate rotation of the spindle relative to the cylinder body 3.

Figure 7:
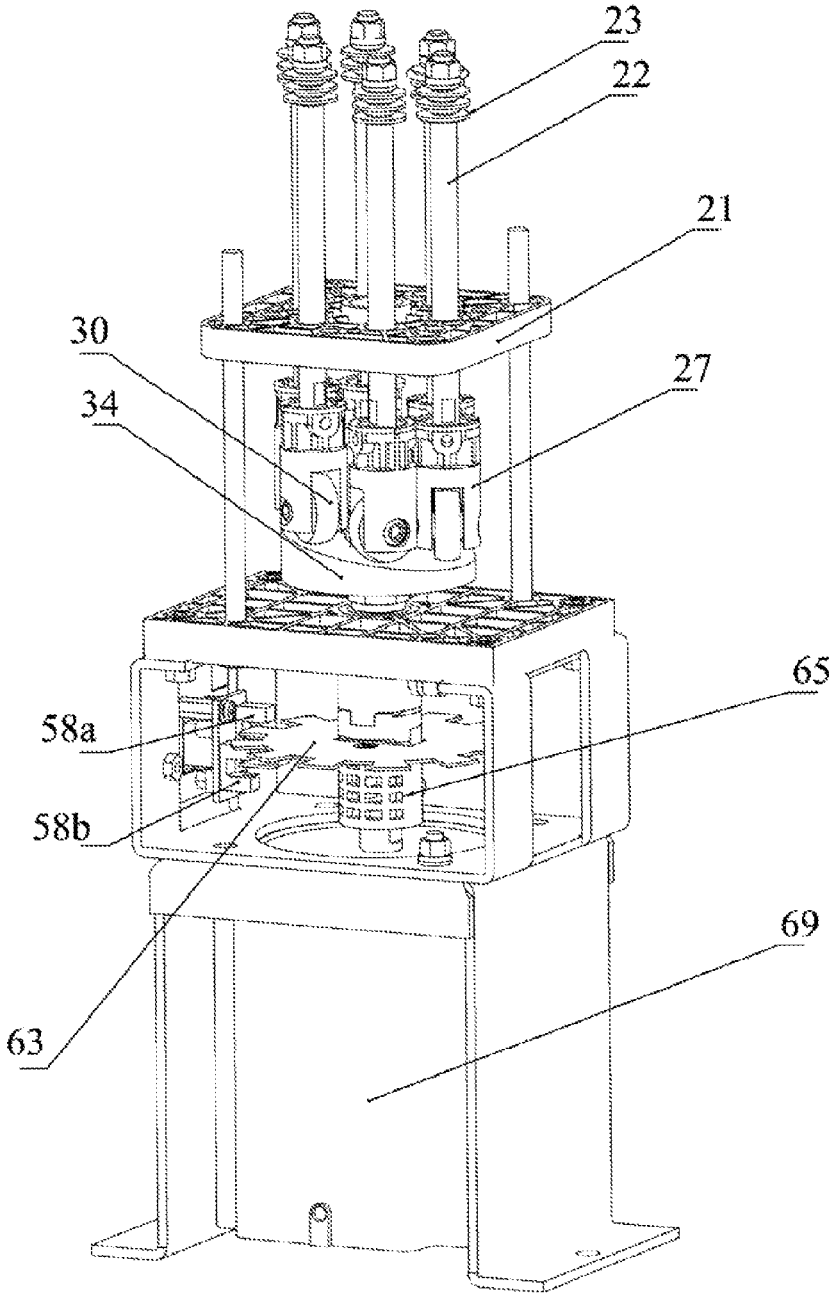
FIG. 7 is a partial perspective view of the embodiment of the supplying device of fixed colorants volume for a colorant dispenser according to the present invention, where a rolling abutment structure and a zero position indicating mechanism according to the present invention are specifically illustrated.

Specifically referring to FIG. 3, FIG. 7 and FIG. 9, the supplying device 1 may further include a zero position indicating mechanism, used for indicating a zero position of rotation of the swashplate relative to the cylinder body. In an ideal state without wear and errors, the supplying device 1, theoretically, may start to indiscriminately supply a precise amount of colorant at any position. However, due to existence of wear and in consideration of requirements for precise supply quantification and a large supply quantity of the colorant, in a particularly preferred embodiment of the present invention, a zero position indicating mechanism according to the present invention is provided, so that any supply of the supplying device 1 can be preferably started at a specified zero position. With such setting, a high-precision quantitative supply of the colorant of the supplying device 1 still can be maintained while the amount of colorant supplied by a turntable in a single revolution is significantly improved.

Figure 10A:
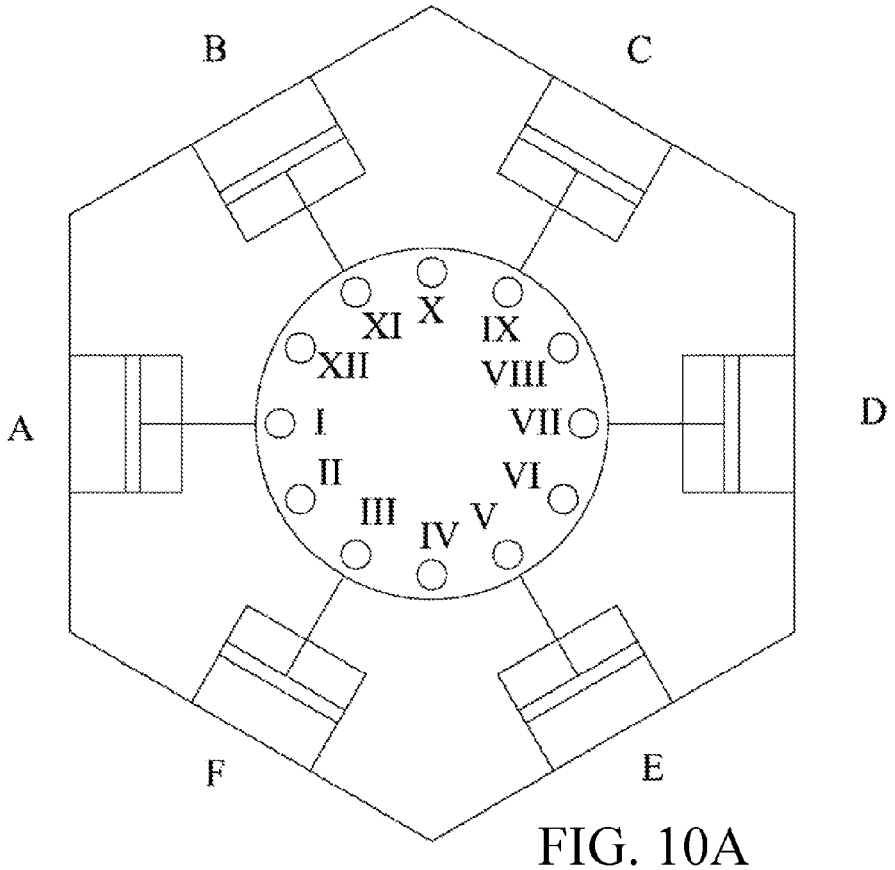
FIG. 10A schematically illustrates a number of piston mechanisms and a number of rotation positions of a swashplate of the supplying device of fixed colorants volume for a colorant dispenser according to the present invention.
Figure 10B:
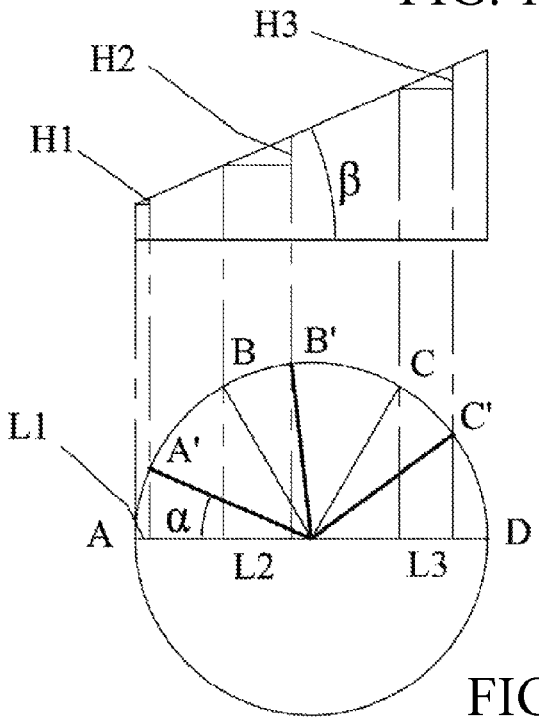
FIG. 10B schematically illustrates a relationship between strokes of the piston mechanisms and rotation angles of the swashplate according to the present invention.

As specifically shown in FIG. 7, the zero position indicating mechanism includes a zero position indicating dial 63 synchronously rotating with the turntable, and a zero position sensor mechanism 58. Herein, for example, when the lowest point (the thinnest portion) of the swashplate rotates to a specified position (for example, the location of the sensor mechanism 58) of a fixed coordinate system of the supplying device 1, a zero position of the turntable is achieved, for example, the rotation position I in FIG. 10A, or the position corresponding to the piston mechanism A in FIG. 10B is the zero position. In the illustrated embodiment, the zero position sensor mechanism 58 includes a first sensor 58A and a second sensor 58B. The sensor mechanism 58 is fixed on a stepper motor support 68 and a sensor support 53 through a sensor fixture 57, and the sensor support 53 is connected to a swashplate shield 52 through a connecting frame 67.

As shown in FIG. 6, the supplying device 1 may further include a three-way valve 18, and the three-way valve is configured to selectively allow the colorant discharged from the piston cylinders 25 and 25A to flow towards an outlet O of the supplying device or to return to the colorant source S. When the supplying device 1 is idling so as to, for example, return to the zero position, the three-way valve 18 can be switched to the right configuration so that the pumped colorant returns to the colorant source S, and in normal operation, the three-way valve 18 is in the left configuration, so that the supplying device can normally pump and supply the colorant quantitatively through the output O. The three-way valve 18 can prevent the colorant from staying in a pipeline for a long time to cause blockage, and may also make a certain segment of the colorant that does not need to be used return to the colorant source S.

Specifically referring to FIG. 1, FIG. 5 and FIG. 6, the supplying device 1 may include a first moving valve plate 6 disposed at or near an outlet of the piston cylinder, and the moving valve plate 6 is arranged coaxially with and synchronously rotates with the swashplate. In addition, the supplying device 1 may further include a second fixed valve plate 5 disposed between the outlet of the piston cylinder and the first moving valve plate 6, and the fixed valve plate 5 is arranged coaxially with but does not synchronously rotate with the swashplate.

The fixed valve plate 5 may have a first fixed valve plate opening 15 in fluid communication with the colorant inlet 2, and the number of the first fixed valve plate opening 15 is one as shown in FIG. 1, FIG. 5 and FIG. 6. The fixed valve plate 5 may further have multiple second fixed valve plate openings 16, which are preferably one-to-one corresponding to the piston cylinders. As shown in the figure, the moving valve plate 6 may have a communicating groove 17, which is communicated with the first fixed valve plate opening 15 and is selectively communicated with a first part of the piston cylinders, so as to allow the colorant to enter the first part of the piston cylinders from the colorant source S through the colorant inlet 2, the first fixed valve plate opening 15, the communicating groove 17, and the corresponding second fixed valve plate openings 16.

The pistons 23 in the first part of the piston cylinders are in the first stroke of the piston for sucking the colorant from the colorant source. The moving valve plate 6 further has a small-diameter portion (see FIG. 1), so as to allow a second part of the piston cylinders (and the corresponding second fixed valve plate openings 16) to be exposed, thereby allowing the colorant to be discharged out of the second part of the piston cylinders and the corresponding second fixed valve plate openings 16 and finally be quantitatively supplied through an opening O. The pistons 23 in the second part of the piston cylinders are in the reverse second stroke of discharging the colorant out of the piston cylinders. In addition, the moving valve plate 6 further has a third structure for covering the piston cylinder 25A in which the piston is at a top dead center or a bottom dead center. As specifically shown in FIG. 4, the moving valve plate 6 covers the piston cylinder 25A in which the piston is at the bottom dead center and the corresponding second fixed valve plate opening 16. With the foregoing configuration of the valve plates, a particularly effective method for supplying a colorant is provided, and precision of colorant dispensing is further improved.

Preferably, the fixed valve plate 5 is made of a wear-resistant material. It can be thought that the fixed valve plate 5 may not be disposed, or an end portion of the cylinder body has the function of the fixed valve plate.

As shown in FIG. 1 and FIG. 4, one end portion of the spindle 13 further has a pressing mechanism 14, which is a pressure spring or another suitable structure and is used for tightly pressing the moving valve plate and/or the fixed valve plate on the end portion of the cylinder body.

Referring to FIG. 3 and FIG. 4, the supplying device 1 may further have an end cover 41 disposed on an outlet end of the cylinder body. The end cover 41, together with the cylinder body, defines an end cover cavity 42, and a check valve 45 allowing the colorant to flow out of the end cover cavity is disposed at an outlet of the end cover. With such configuration, the end cover cavity 42 of the supplying device 1 is usually filled with the colorant, and through rotation at the drive plate 34, a certain amount of colorant is forcibly discharged into the end cover cavity 42 when the piston mechanism makes stroke movements, thereby avoiding that the check valve 45 discharges a fixed amount (incremental amount) of the colorant outside the outlet of the supplying device 1. With such arrangement, the amount of the colorant supplied is more precise, and the supply of the colorant is more stable, for example, loss of the colorant during supply is greatly reduced.

Operations of the supplying device of fixed colorants volume for a colorant dispenser 1 according to the present invention will be described as an example below with reference to FIG. 10A and FIG. 10B. That the supplying device 1 is provided with six piston mechanisms (piston cylinders) A-F is used as an example, description is given with the lowest point of the swashplate rotating counter-clockwise sequentially through 12 rotation positions I-XII that are evenly spaced (each at an interval of 30°) in the circumference, and it is assumed that the rotation position I is just at the zero position. In FIG. 10A, the six piston mechanisms (piston cylinders) A-F are not drawn schematically in accordance with the actual structure.

Position I: the piston cylinder A is cut off (the bottom dead center of the piston mechanism), the piston cylinder D is cut off (the top dead center), the piston cylinders B and C discharge the colorant (the second stroke), and the piston cylinders E and F suck the colorant (the first stroke);

Position II: the piston cylinders A, B and C discharge the colorant, and the piston cylinders D, E and F suck the colorant;

Position III: the piston cylinders C and F are cut off, the piston cylinders A and B discharge the colorant, and the piston cylinders D and E suck the colorant;

Position IV: the piston cylinders A, B and F discharge the colorant, and the piston cylinders C, D and E suck the colorant;

Position V: the piston cylinders B and E are cut off, the piston cylinders A and F discharge the colorant, and the piston cylinders C and D suck the colorant;

Position VI: the piston cylinders A, E and F discharge the colorant, and the piston cylinders B, C and D suck the colorant;

Position VII: the piston cylinders A and D are cut off, the piston cylinders E and F discharge the colorant, and the piston cylinders B and C suck the colorant;

Position VIII: the piston cylinders D, E and F discharge the colorant, and the piston cylinders A, B and C suck the colorant;

Position IX: the piston cylinders C and F are cut off, the piston cylinders D and E discharge the colorant, and the piston cylinders A and B suck the colorant;

Position X: the piston cylinders C, D and E discharge the colorant, and the piston cylinders A, B and F suck the colorant;

Position XI: the piston cylinders B and E are cut off, the piston cylinders C and D discharge the colorant, and the piston cylinders A and F suck the colorant; and Position XII: the piston cylinders B, C and D discharge the colorant, and the piston cylinders A, E and F suck the colorant.

It can be known from FIG. 10A that, for configuration of the six piston cylinders, from the zero position, a new piston mechanism is located at the lowest point of the swashplate within each 60°.

FIG. 10B schematically describes a relationship between strokes of the piston mechanisms and rotation angles of the swashplate. It should be noted that, the coordinate system of the swashplate is described in FIG. 10B, and the piston mechanisms (piston cylinders) are regarded as rotating relative to the swashplate in a clockwise direction. A rotation angle $\alpha$ within the range of the rotation positions I to III (that is, the angle is less than or equal to 60°) is used as an example, and it is equivalent to that the piston mechanisms (piston cylinders) rotate clockwise by an angle $\alpha$. Herein, only the piston mechanisms (piston cylinders) A, B and C discharging the colorant at this time are analyzed. Before rotating, the piston mechanisms (piston cylinders) A-C each have a projection (corresponding to A, B and C) on a diameter extending through the highest point and the lowest point of the swashplate, and after rotating, each have another projection (corresponding to A', B' and C') relative to the diameter. Projection intervals L1, L2 and L3 are separately defined between projections, and strokes H1, H2 and H3 of the piston mechanisms A, B and C can be obtained after the intervals are projected onto the swashplate having a swashplate angle $\beta$.

Therefore, the turntable 34 rotates by the rotation angle $\alpha$, and a theoretical value of the amount of the colorant supplied by the supplying device 1 is: $V=\pi r^2(H1+H2+H3)$; where r is the radius of the piston cylinders, and it is assumed that the piston cylinders have the same radial dimension.

Similarly, in the rotation angle $\alpha$, the amount of the colorant sucked by the supplying device 1 is also V.

Therefore, the supplying device of fixed colorants volume for a colorant dispenser 1 of the present invention can significantly increase the amount of colorant supplied. Moreover, the supplying device of fixed colorants volume for a colorant dispenser 1 can further provide precise quantitative supply and provide a single minimum supply as small as possible. In addition, the supplying device of fixed colorants volume for a colorant dispenser 1 is durable and has a long service life.

The present invention is illustrated and described with reference to the foregoing embodiments, and the description is merely illustrative. Persons skilled in the art will understand that various modifications can be made to the embodiments of the present invention described herein, to implement the present invention without departing from the spirit and scope of the present invention defined by the appended claims and equivalents thereof. The above description of the present invention should be construed as including all novel and non-obvious combinations of elements described herein.

The invention claimed is:

1. A supplying device of fixed colorants volume for a colorant dispenser, comprising:

a colorant source;

a cylinder body having multiple piston cylinders arranged around a circumferential direction thereof;

a swashplate having an oblique surface and arranged substantially coaxially with the cylinder body, and configured to be capable of rotating around a longitudinal axis thereof and relative to the cylinder body;

multiple piston mechanisms, wherein each piston mechanism comprises a piston rod and a piston connected to the piston rod, the piston rod has a rolling abutment structure abutting against the oblique surface, and the piston is configured to be capable of making a stroke movement in the corresponding piston cylinder by means of rotation of the swashplate;

an actuator for actuating the swashplate;

a controller operatively connected to the actuator to control the amount of rotation of the swashplate;

an outlet for dispensing a colorant; and an axial reset mechanism for biasing the rolling abutment structure towards the oblique surface along an axial direction;

a circumferential reset mechanism capable of applying a circumferential restoring force to the rolling abutment structure during rotation of the swashplate, so as to make the rolling abutment structure tend to restore a predetermined abutment state with the oblique surface, wherein the stroke movement of each of the pistons comprises a first stroke and a reverse second stroke, in the first stroke, the piston cylinder of the piston is in communication with the colorant source so as to draw the colorant from the colorant source, and in the second stroke, the colorant drawn from the colorant source is discharged out of the piston cylinder;

a moving valve plate disposed near outlets of the piston cylinders, the moving valve plate is arranged coaxially with and synchronously rotates with the swashplate, and the moving valve plate including a first structure defining a colorant channel that fluidly connects the colorant source to a first part of the piston cylinders, a second structure allowing the colorant to be discharged from a second part of the piston cylinders, and a third structure used for covering a third part of the piston cylinders, wherein the pistons in the first part of the piston cylinders are in the first stroke, the pistons in the second part of the piston cylinders are in the second stroke, and the pistons in the third part of the piston cylinders are at a top dead center or a bottom dead center between the first stroke and the second stroke;

a fixed valve plate disposed between the moving valve plate and the cylinder body, the fixed valve plate not rotating with the swashplate and having a fixed position relative to the cylinder body, the fixed valve plate including a first opening and second openings, the first opening fluidly connected to the colorant source and configured to provide the colorant to the colorant channel of the moving valve plate, the fixed valve plate having a respective one of the second openings for each of the pistons, wherein the colorant channel of the moving valve plate fluidly connects the first opening of the fixed valve plate to each of the second openings of the fixed valve plate that corresponds to one of the pistons of the first part of the piston cylinders, and the colorant being provided from the colorant source to each one of the pistons of the first part of the piston cylinders by flowing from the color source through the first opening, the colorant channel, and the one of the second openings corresponding to the piston; and a zero position indicating mechanism used for indicating a zero position of rotation of the swashplate relative to the cylinder body, wherein wherein the moving valve plate has a thickness, the colorant channel is a groove in a side of the moving valve plate that faces the fixed valve plate, and the groove extends through less than the entire thickness of the moving valve plate.

2. The device according to claim 1, wherein the actuator comprises a stepper motor.

3. The device according to claim 1, wherein the axial reset mechanism and the circumferential reset mechanism are jointly formed by a spring, the spring is axially disposed between the rolling abutment structure and the cylinder body and has a first end fixedly connected to the rolling abutment structure and a second end fixedly connected to the cylinder body.

4. The device according to claim 1, wherein the piston rod comprises a rod body, and the rod body has a first end connected to the piston and a second end rotatably connected to the rolling abutment structure.

5. The device according to claim 4, wherein the rolling abutment structure comprises a bearing seat and a rolling bearing member pivotally mounted on the bearing seat.

6. The device according to claim 5, wherein the rolling bearing member comprises a pivot mounted on the bearing seat, a bearing sleeved over the pivot and an outer member sleeved over the bearing, and the outer member at least partially defines a spherical contact surface abutting against the oblique surface.

7. The device according to claim 1, wherein the piston is configured such that the colorant in the piston cylinder is isolated from the piston rod in a colorant impermeable manner.

8. The device according to claim 1, further comprises:

a three-way valve configured to selectively allow the colorant discharged from the piston cylinder to flow to the outlet or to return to the colorant source.

9. The device according to claim 1, wherein the outlet is further provided with a check valve.

10. The device according to claim 1, wherein the device further comprises a sleeve member fixedly mounted in each piston cylinder and slidably sleeved over the piston rod.

11. A colorant dispenser, comprising at least one supplying device of fixed colorants volume according to claim 1.

12. A supplying device of fixed colorants volume for a colorant dispenser, comprising:

a colorant source;

a cylinder body having multiple piston cylinders arranged around a circumferential direction thereof;

a swashplate having an oblique surface and arranged substantially coaxially with the cylinder body, wherein the swashplate is configured to be capable of rotating around a longitudinal axis thereof and relative to the cylinder body;

multiple piston mechanisms, wherein each piston mechanism comprises a piston rod and a piston connected to the piston rod, and the piston is configured to be capable of making a stroke movement in the corresponding piston cylinder through rotation of the swashplate;

an actuator for actuating the swashplate to rotate around the longitudinal axis and relative to the cylinder body;

a controller operatively connected to the actuator to control the amount of rotation of the swashplate; and an outlet for dispensing a colorant, wherein the stroke movement of each of the pistons comprises a first stroke and a reverse second stroke, in the first stroke, the piston cylinder of the piston is in communication with the colorant source so as to draw the colorant from the colorant source, and in the second stroke, the colorant drawn from the colorant source is discharged out of the piston cylinder;

a moving valve plate disposed near outlets of the piston cylinders, the moving valve plate is arranged coaxially with and synchronously rotates with the swashplate, and the moving valve plate including a first structure defining a colorant channel that fluidly connects the colorant source to a first part of the piston cylinders, a second structure allowing the colorant to be discharged from a second part of the piston cylinders, and a third structure used for covering a third part of the piston cylinders, wherein the pistons in the first part of the piston cylinders are in the first stroke, the pistons in the second part of the piston cylinders are in the second stroke, and the pistons in the third part of the piston cylinders are at a top dead center or a bottom dead center between the first stroke and the second stroke;

a fixed valve plate disposed between the moving valve plate and the cylinder body, the fixed valve plate not rotating with the swashplate and having a fixed position relative to the cylinder body, the fixed valve plate including a first opening and second openings, the first opening fluidly connected to the colorant source and configured to provide the colorant to the colorant channel of the moving valve plate, the fixed valve plate having a respective one of the second openings for each of the pistons, wherein the colorant channel of the moving valve plate fluidly connects the first opening of the fixed valve plate to each of the second openings of the fixed valve plate that corresponds to one of the pistons of the first part of the piston cylinders, and the colorant being provided from the colorant source to each one of the pistons of the first part of the piston cylinders by flowing from the color source through the first opening, the colorant channel, and the one of the second openings corresponding to the piston; and a zero position indicating mechanism synchronously rotating with the swashplate, used for indicating a zero position of rotation of the swashplate relative to the cylinder body wherein the moving valve plate has a thickness, the colorant channel is a groove in a side of the moving valve plate that faces the fixed valve plate, and the groove extends through less than the entire thickness of the moving valve plate.

13. The device according to claim 12, further comprising:

a three-way valve disposed between the piston cylinder and the outlet, and the three-way valve is configured to selectively allow the colorant discharged from the piston cylinder to flow to the outlet or to return to the colorant source.

14. The device according to claim 12, wherein the actuator comprises a stepper motor.

15. A colorant dispenser, comprising at least one supplying device of fixed colorants volume according to claim 12.

* * * * *